US006036273A

United States Patent [19]

Lin

[11] Patent Number: 6,036,273

[45] Date of Patent: Mar. 14, 2000

[54] CHAIR STRUCTURE

[76] Inventor: Steve Lin, No. 80, Kengtsai Ping, Hoping Village, Chuchi Hsiang, Chiayi Hsien, Taiwan

[21] Appl. No.: 09/198,313

[22] Filed: Nov. 23, 1998

[51] Int. Cl.[7] ..... A47C 4/34

[52] U.S. Cl. ..... 297/452.63; 297/463.1

[58] Field of Search ..... 297/452.63, 463.1, 297/440.1, 440.2; 5/191, 236.1, 237, 238; 248/345.1

[56] References Cited

U.S. PATENT DOCUMENTS

| | | | |
|---|---|---|---|
| 2,016,953 | 10/1935 | Arnold | 297/452.63 X |
| 3,135,552 | 6/1964 | Lockshin | 297/452.63 |
| 5,901,523 | 5/1999 | Tasi | 248/223.41 X |

FOREIGN PATENT DOCUMENTS

| | | | |
|---|---|---|---|
| 325568 | 7/1989 | European Pat. Off. | 5/236.1 |
| 381293 | 8/1990 | European Pat. Off. | 5/238 |
| 572895 | 12/1993 | European Pat. Off. | 5/237 |
| 2547186 | 12/1984 | France | 5/238 |
| 1958100 | 5/1971 | Germany | 5/191 |
| 2049635 | 4/1972 | Germany | 5/236.1 |

*Primary Examiner*—Peter R. Brown
*Attorney, Agent, or Firm*—Dellett and Walters

[57] ABSTRACT

A chair includes a seat portion, a back portion and four legs supporting the combination of the seat portion and the back portion. Each of the seat portion and the back portion has two side tubes and each side tube has two flanges extending therefrom so as to define a slot between the two opposite flanges. A plurality of slats are securely fitted between the two opposite pairs of flanges of the seat portion and the back portion by bolts extending through the flanges and the slats.

2 Claims, 4 Drawing Sheets

CHAIR STRUCTURE

FIELD OF THE INVENTION

The present invention relates to a chair, and more particularly, to an improved chair structure comprising a back portion and a seat portion each including two tubes and each tube having two flanges extending therefrom so that slats are respectively and transversely inserted between the two slots defined by the two pairs of flanges of the two tubes and secured by bolts and nuts.

BACKGROUND OF THE INVENTION

FIG. 4 shows a conventional chair (10) which includes a back portion (101) and a seat portion (102) with a plurality of slats (13) fixedly connected between the two side tubes (103, 104) of the back portion (101) and the seat portion (102). Two arms (11) connected between the back portion (101) and the seat portion (102), and two front legs and two rear legs (12) respectively extend from the two arms (11). It is noted that the side tubes (103, 104) are cylindrical tubes so that the side tubes (103, 104) are pressed to have a plurality of flat recesses to conveniently allow the bolts extending therethrough to fixedly attach the slats (13). It takes time to further press the side tubes (103, 104) to form the flat recesses and therefore increases the manufacturing costs. In addition, the positions of the flat recesses have to be checked carefully to ensure that each pair of the flat recesses are located in the same horizontal plane so that the slat fitted into the corresponding pair of the slots is attached horizontal.

The present invention intends to provide a chair structure comprising two flanges extending from each of the side tubes so that the slats are conveniently fitted into the slots defined by the flanges of the two side tubes. The chair structure of the present invention overcomes the shortcomings found in the conventional chairs mentioned above.

SUMMARY OF THE INVENTION

In accordance with one aspect of the present invention, there is provided a chair structure comprising a back portion connected to a seat portion and four legs supporting the combination of the back portion and the seat portion. The back portion and the seat portion each comprise two side tubes and each of the two side tubes has two flanges extending radially outward therefrom so as to define a slot between each pair of the two flanges. The two ends of each slat is inserted into the two opposite slots of the two side tubes of the back portion and the seat portion, and are securely attached between the two side tubes of the back portion and the seat portion.

The main object of the present invention is to provide a chair structure wherein the slats are conveniently connected between two side tubes of the seat portion and the back portion.

Another embodiment of the present invention is to provide a chain structure wherein the chair is assembled quickly and effectively.

Further objects, advantages, and features of the present invention will become apparent from the following detailed description with appropriate reference to the accompanying drawings.

DETAILED DESCRIPTION OF THE PREFERRED EMBODIMENT

Figure 1:
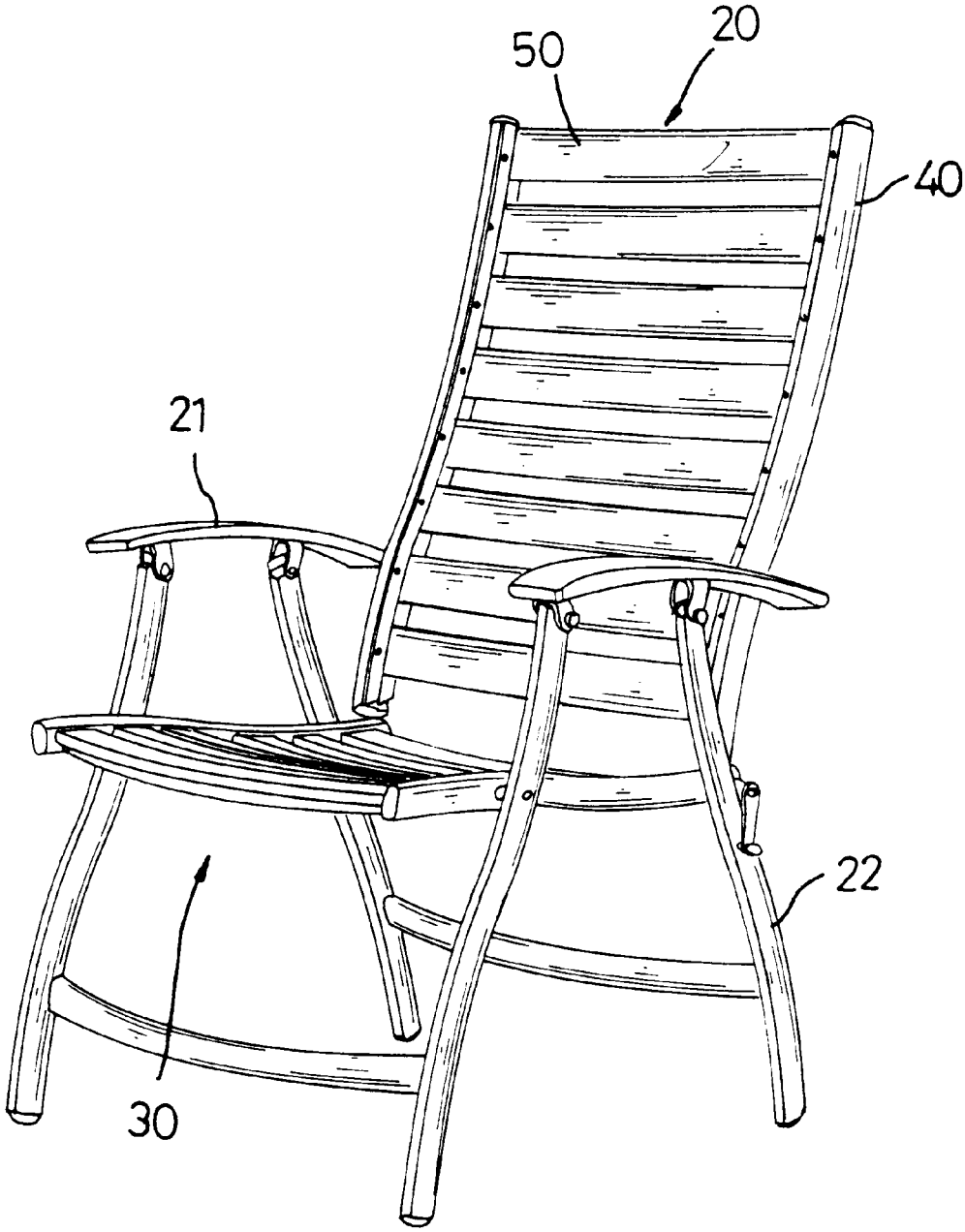
FIG. 1 is a perspective view of the chair in accordance with the present invention.
Figure 2:
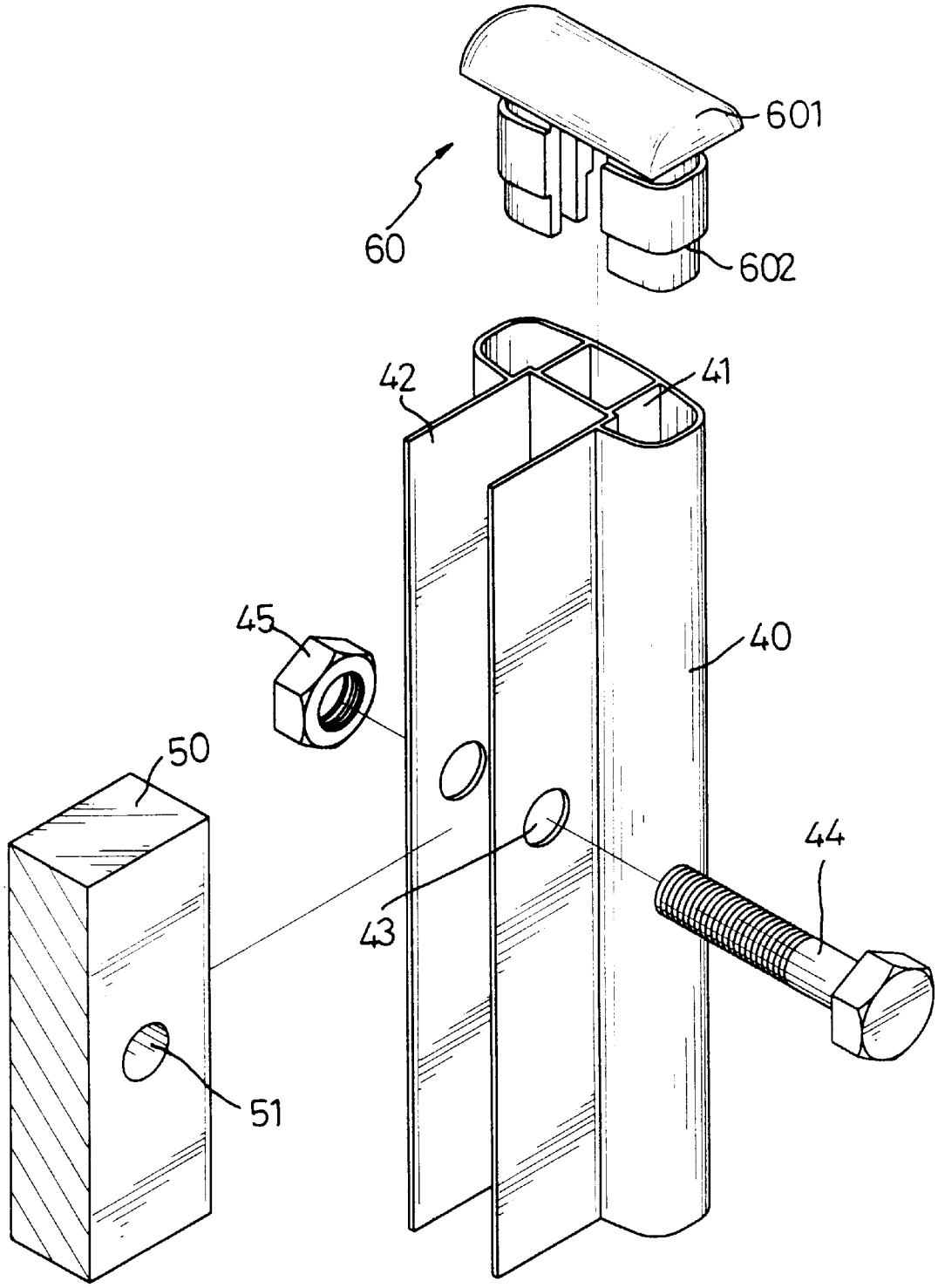
FIG. 2 is an exploded view of one of the side tubes, the slat, the bolt to securely connect the slat to the side tube and the cap member of the chair in accordance with the present invention.
Figure 3:
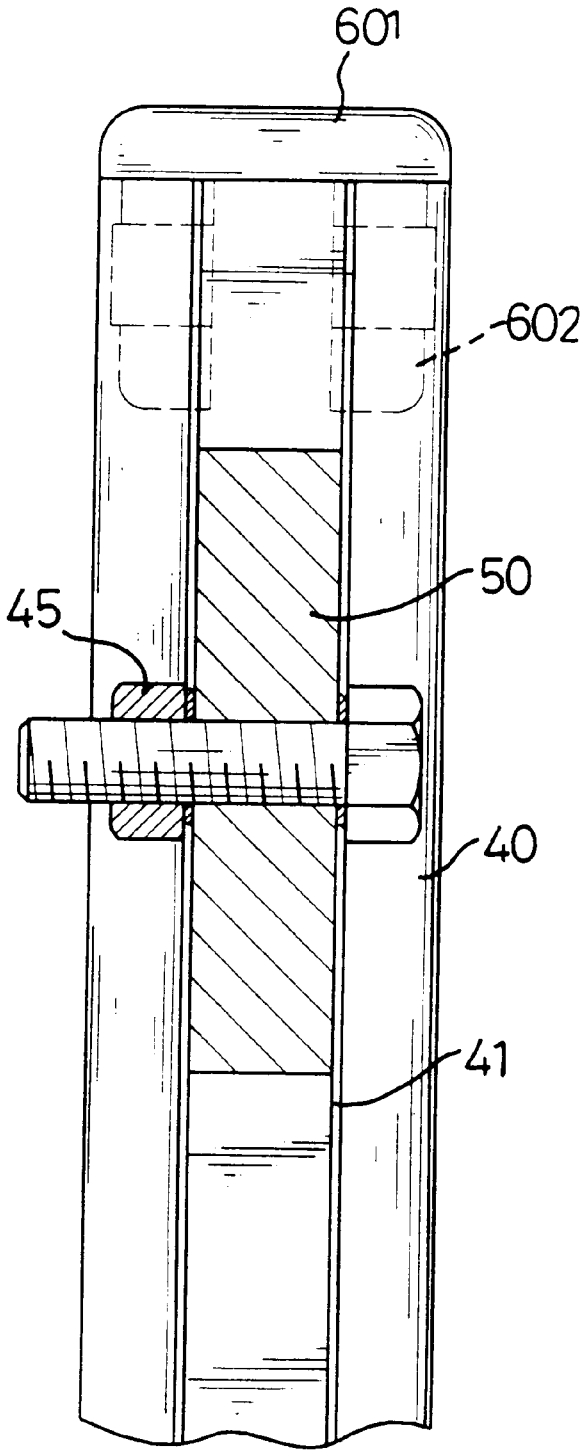
FIG. 3 is a side elevational view, partly in section, of the combination of the parts shown in FIG. 2.
Figure 4:
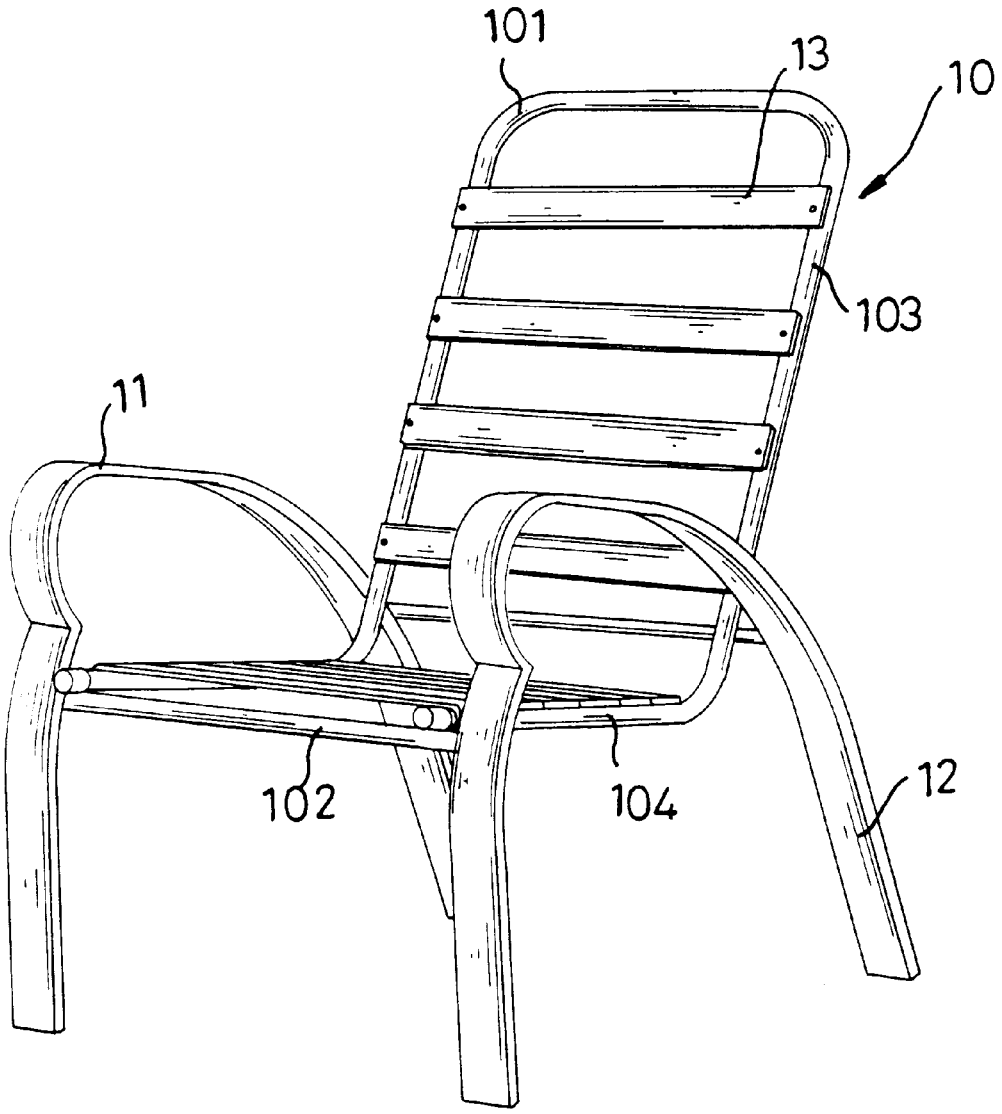
FIG. 4 PRIOR ART
FIG. 4 is a perspective view of the conventional chair.

Referring to FIGS. 1 to 3, the chair structure in accordance with the present invention comprises a back portion (20), a seat portion (30), two arms (21) extending from the back portion (20) and four legs (22) respectively extending from the two arms (21) so that the four legs (22) support the combination of the back portion (20) and the seat portion (30). Each of the back portion (20) and the seat portion (30) comprises two side tubes (40), each of the side tubes (40) has two flanges (42) extending radially outward therefrom so as to define a slot between each pair of the two flanges (42). Each pair of the two flanges (42) have a plurality of aligned pairs of holes (43) defined therethrough so as to let bolts (44) extend therethrough. The two ends of a plurality of slats (50) are respectively inserted into the two opposite slots of the side tubes (40) and securely attached between the two side tubes (40) by extending the bolts (44) through the aligned holes (43) and the holes (51) in the ends of the slats (50) and engaged with nuts (45). Therefore, when assembling the chair, the slats (50) are easily and precisely attached in the slots so that the assembly time is effectively reduced.

Each of the side tubes (40) has a cap member (60) inserted into each end thereof. Each of the two ends of each of the side tubes (40) has two separating ribs (41) so as to define three partitions therein and each cap member (60) has a top with two protrusions (602) extending therefrom. The two protrusions (602) are sized to be force-fitted into two of the three partitions such that the side tubes (40) have a good outer appearance.

The chair structure allows the assembler to assemble the chairs within a short period of time and the manufacturers to mass-produce the parts of the chair.

Although the invention has been explained in relation to its preferred embodiment, it is to be understood that many other possible modifications and variations can be made without departing from the spirit and scope of the invention as hereinafter claimed.

What is claimed is:

1. A chair structure comprising a back portion connected to a seat portion and four legs supporting the combination of said back portion and said seat portion, said back portion comprising two side tubes, each of said two side tubes having two flanges extending radially outward therefrom so as to define a slot between each pair of said two flanges, each of said side tubes having a cap member inserted into at least one of the two ends thereof and two separating ribs so as to define three partitions therein, said cap member having a top with two protrusions extending therefrom, and said two protrusions fitted into two of said three partitions, and a plurality of slats with two ends respectively inserted into said opposite slots of said two side tubes and being securely attached between said two side tubes.

2. A chair structure comprising a back portion connected to a seat portion and four legs supporting said combination of said back portion and said seat portion, said seat portion comprising two side tubes, each of said two side tubes having two flanges extending radially outward therefrom so as to define a slot between each pair of said two flanges, each of said side tubes having a cap member inserted into at least one of the two ends thereof and two separating ribs so as to define three partitions therein, said cap member having a top with two protrusions extending therefrom, and said two protrusions fitted into two of said three partitions, and a plurality of slats with two ends respectively inserted into opposite slots of said two side tubes and being securely attached between said two side tubes.

* * * * *